United States Patent [19]

Taylor

[11] 4,225,392

[45] Sep. 30, 1980

[54] PYROLYSIS APPARATUS

[76] Inventor: Leland T. Taylor, 701 Madison St. NE., Albuquerque, N. Mex. 87110

[21] Appl. No.: 939,204

[22] Filed: Sep. 5, 1978

[51] Int. Cl.[2] ..... C10B 9/00; C10B 1/04; C10J 3/20

[52] U.S. Cl. ..... 202/93; 202/120; 202/221; 48/85; 48/73

[58] Field of Search ..... 48/76, 77, 86 R, 85, 48/111; 422/164, 125, 232; 202/120, 221, 93; 366/292, 297, 299

[56] References Cited

U.S. PATENT DOCUMENTS

| | | | |
|---|---|---|---|
| 580,247 | 4/1897 | Berg et al. | 48/76 |
| 1,267,410 | 5/1918 | Hornsey | 48/85 |
| 2,689,787 | 9/1954 | Ogorzaly et al. | 48/76 |
| 3,454,382 | 7/1969 | Hamilton | 48/76 |
| 3,676,365 | 7/1972 | Shirai et al. | 202/221 |
| 3,746,521 | 7/1973 | Giddings | 48/111 |
| 4,011,059 | 3/1977 | Daly et al. | 48/86 R |

*Primary Examiner*—S. Leon Bashore
*Assistant Examiner*—Chris Konkol
*Attorney, Agent, or Firm*—Eyre, Mann, Lucas & Just

[57] ABSTRACT

A conical reaction region in a pyrolysis device has an adjustable height, adjustable speed agitator in the vicinity of the grate and a second agitator stirring the incoming material. A feed auger stops short of the reaction chamber to produce a sealing region in which the incoming feed material effectively produces a gas tight seal preventing the exit of reaction products. A gas outlet flow rate sensor controls the air inflow rate and/or lower agitator speed. Temperature and other sensors may be used to further optimize the process.

22 Claims, 2 Drawing Figures

PYROLYSIS APPARATUS

BACKGROUND OF THE INVENTION

The present invention is related to pyrolysis of organic material to produce combustible gas and/or recover chemical components from the pyrolyzed organic material.

Pyrolysis requires the destructive distillation of combustible gases from organic material using heat of combustion of the organic material to maintain the reaction. Organic material to be pyrolyzed is added at the top of a sealed reaction vessel and migrates toward the bottom of the reaction vessel. A grate near the bottom of the reaction vessel supports above it a combustion zone where the residue from the process is combusted to produce the heat required to support the reaction. The heat from the combustion zone is forced upward through the mass of new material by an air blast through the grate. The heated air and gases cause destructive distillation of the carbohydrate material and the generation of carbon monoxide and carbohydrate gases according to the following reaction:

$$C_xH_yO_z+O_2=C+CO+CO_2+C_{xl-xn}H_{yl-yn}O_{zl-zn}$$

In an efficient pyrolysis device in which the desired output is product gas, the free carbon in the products of combustion should be minimized or effectively zero. Further, the $CO_2$ should also be minimized.

The problem encountered in prior art pyrolysis equipments such as shown in U.S. Pat. No. 3,983,009 is the proper balancing of air flow rate, material agitation and material feed rate to provide the simultaneous reaction parameters which will minimize carbon and carbon dioxide output and maximize product gas output. The primary control in the 3,983,009 patent is a change in the air flow rate through the grate and a change in the rate of addition of new material at the top of the reaction chamber. These parameters must be controlled within very narrow limits and, in practice, it has been discovered that it is not possible to control these parameters on a long-term basis to fully utilize the carbon. An insufficient air flow rate fails to burn the char before it passes through the grate. An excessive air flow rate in the 3,983,009 device expels the unreacted raw material and partially reacted material through the gas outlet.

SUMMARY OF THE INVENTION

The applicant has discovered an apparatus for pyrolysis of solid hydrocarbon materials which overcomes the problems in the prior art.

Specifically, the applicant has discovered that efficient pyrolysis of organic material requires a careful balancing of air flow, feed inflow and waste outflow. The required balancing cannot be adequately controlled by control of air flow alone or of air flow combined with material input. The applicant has discovered that, by placing a grate in a tapering reaction chamber and by placing an agitator over the grate which is variable both in agitation rate and height above the grate, and by varying air flow, agitation rate and feed rate, an efficient system making maximum use of the carbon in the system to destructively distill gaseous hydrocarbons can be produced.

The present system is capable of consuming hydrocarbon material, preferably reduced to particle sizes no larger than one to two inches. For very wet organic material such as municipal refuse, it may be necessary to predry the material for effective pyrolysis. Pyrolysis of any suitable solid hydrocarbon, including but not limited to wood, bark, sawdust, paper and coal is contemplated by the present invention.

A tapering lower body, preferably conical or inverted pyramidal, is provided with a grate intermediate thereof and is joined at its upper perimeter to a bin of uniform cross section. Below the grate, the conical section tapers to an air tight ash disposal device. A blower, connected to the tapering section below the grate, is controlled by a control system operating on a waste-gate pressure controller to provide a given product gas outflow rate.

The lower agitator, which may be a rotating or an oscillatory type, is located from about 0.25 to about 4 inches above the grate. The lower agitator is moveable upward or downward as required to accommodate different sizes of material and to control the rate of final reduction of the carbon. For coarser materials, the lower agitator is raised further from the grate; and for finer material it is moved closer. For example, for reducing sawdust, a spacing of 0.25 to 1.5 inches is successful. For bark having 0.5 inch particle size, a spacing of from about 1 to about 2 inches has been found effective.

The cycle rate of the lower agitator controls the rate of final reduction of the char. Faster actuation of the lower agitator speeds up the burning process and the throughput of the system. As the material is reduced to ash, the air flow rate through the reaction zone tends to increase. The control system may be connected to reduce the rate of rotation in response to this change. In one embodiment of the invention, the air flow in and the rotation rate of the lower agitator are both controlled by the control system.

An upper agitator in the uniform cross section upper section of the device stirs the incoming raw material to prevent caking and blockage and to deliver the material to the reaction zone and the lower agitator. The rotation rate requirements for the upper agitator is significantly different from the requirements for the lower agitator. Consequently, the upper agitator is operated at a different rate from the lower agitator. The upper agitator may consist of arms rotating about a vertical axis or of discs or arms rotating about a horizontal axis. It has been found that the precise location of the upper agitator and its rotation rate are not critical. Consequently, no dynamic control of the rotation rate of the upper agitator is provided. For most material types, the upper agitator height may remain fixed and its rotation rate may be constant. Provision may be included for changing both the height and the rotation rate of the upper agitator to accommodate different feed materials. The upper agitator may be operated continuously or intermittently. In the preferred embodiment, the upper agitator is operated intermittently for from about 2 to about 20 seconds with a pause of from about 10 to about 240 seconds and most preferably is operated intermittently for from about 6 to about 10 seconds with a pause of between about 20 and about 60 seconds as required to provide a levelling effect on the feed material.

The upper agitator may be a blade-type agitator rotating about a vertical axis, wheel-type agitator rotating about a horizontal axis or other agitator means which will properly keep the feed material in the upper portion of the device from caking and blocking flow while maintaining it substantially level. When a blade-type upper agitator rotating about a vertical axis is employed, it is convenient to also use a blade-type lower agitator rotating about a vertical axis where the axes of the upper and lower agitators are concentric and coaxial.

The raw material feed apparatus may also be automatically controlled by a level sensor placed in the system in order to balance the incoming material against changes in material consumption due both to air flow rate and lower agitation. In the preferred embodiment of the invention, the feed apparatus is an auger which pushes the feed material into the upper portion of the apparatus. The auger is terminated a predetermined distance short of the outflow point. A hinged door at the outflow point permits the newly fed material to pack into an outer chamber between the end of auger and the outflow point. Upon being exposed to the heat and gases at the top of the reaction chamber, most types of hydrocarbon materials tend to swell. This is especially true of smaller diameter material. Through this packing and swelling, a gas-tight seal is created to prevent the outflow of product gas through the feeder mechanism. The applicant has discovered that by terminating the auger short of the outflow point by a distance at least equal to the diameter of the auger, proper sealing is obtained. Continuing the auger further toward the outfall point does not permit a proper seal to be obtained. Certain materials, particularly materials having larger particle sizes, may not adequately seal the outer chamber against the flow of gas. A positive sealing feed system, for example of a type well known in the art, may be substituted for the self-sealing feed system above described without departing from the scope of the present invention.

Control of the controlled functions may be based on a number of different sensed parameters used either alone or in combination. In one embodiment reduced to practice, the outflow rate of product gas through a restricted orifice generates a pressure which is sensed by a pressure sensor. The pressure sensor actuates both the air control and lower agitator control to maintain the product gas outflow rate substantially constant.

Other sensors may be used to provide total or partial control of the system. For example, it is well known that varying the temperatures in the reaction zone can change the percentage of chemical byproducts in the product gas. The fraction of the three principal chemical byproducts of destructive distillation, namely acetic acid, methyl alcohol and acetone which are recovered in the destructive distillation of wood, can be varied by varying the temperature in the reaction zone. Since the control system is equally sensitive to sensed temperatures, the operating parameters of the system can be automatically controlled to maintain a desired temperature range either at a particular region of the apparatus or a desired temperature profile encompassing a number of locations in the apparatus. For example, it is possible to sense the temperatures in the regions of the product gas outflow, where destructive distillation occurs and the combustion zone. By varying air flow rate, lower agitator rate and feed rate, the temperature profile as measured by these three temperature sensors may be adjusted.

Chemical sensing of the product gas outflow may also be used as a control input. For example, the proportion of one or more gas or chemical constituents or the ratio of percentages of one gas to another gas may be employed in the control. For example, the percentage of methyl alcohol in the outflow gas is preferably optimized. This may be accomplished by elevating the temperature in the reaction zone. As the temperature in the reaction zone becomes too high, other changes in the outflow gas may be sensed to stop the increase.

In a second embodiment of the invention, the lower agitator is an oscillatory grate located an adjustable distance above the burner grate. The oscillatory grate is driven at a variable rate by air pressure. The oscillatory rate of the lower agitator may be controlled by air pressure varying in proportion to the pressure of the inflowing air at the bottom of the apparatus. The inflowing air pressure, is in turn, controlled by the control system. Consequently, the air flow rate (being dependent upon incoming air pressure) and the oscillation frequency of the lower agitator are automatically controlled together by the control of the inflowing air pressure. The oscillatory lower agitator may have a stroking frequency of from about 0.1 cycles per minute to about 20 cycles per minute. The travel limits of the lower agitator may be varied to control throughput and quality of the gas output. It would be clear to one skilled in the art that, a shorter travel would require higher oscillation rate to achieve the same rate of consumption of material. A travel of the lower agitator of from about 0.25 inches to about 8 inches may be employed with the preferred amount of travel being from about 2 to about 6 inches and the most preferred being from about 3 to about 5 inches.

By varying the parameters previously discussed, the apparatus can be employed to produce high quality charcoal at the expense of its efficiency in producing combustible product gas. The reduction in efficiency comes about because the full oxidation of the char maximizes the production of combustible byproducts in the gas formed. Producing char requires a sacrifice of some of the gas output.

In each embodiment of the invention, the primary reaction region in the vicinity of the grate and lower agitator is generally conical. The conical shape permits a rapid flow of air through the combustion region thereby retarding the formation of $CO_2$ and encouraging the formation of CO and other combustible byproducts. In addition, the conical shape with the controllable parameters previously discussed permits the simultaneous complete reduction of the char and the maintenance of a reaction temperature of 650° C. or greater in the pyrolytic reaction region to form the required destructive distillation of the hydrocarbon feed material. As the material is destructively distilled its volume is reduced. This relationship maintains a uniform material flow through rate.

By employing the reduced area in the conical region for the final reduction of char to ash, the total volume of air flowing through the pyrolytic reaction zone enlarges the range of air flow volume which can produce satisfactory pyrolytic reaction. Without the cone shaped portion, the air flow required to complete the reaction with the char is frequently sufficient to cause tunneling through the reaction zone and feed material resulting in blowing out of raw material from the system. This problem is avoided with a conical system.

The conical system allows a wider range of operating air flows which permits a wider range of output product rate. In order to "idle" the system, a minimum temperature is required which requires a minimum air flow. This air flow would be close to maximum air flow in a circular or linear system, however in the conical system according to the present invention, the idling air flow rate is substantially lower. At low air flow rates combustion takes place lower in the conical section, thus reducing the rate at which raw material is pyrolyzed and reducing product demand correspondingly. As the air flow is increased from idle the pyrolytic temperature range moves higher in the conical system thus increasing the area of combustion and pyrolysis, consuming more material, producing a greater range of output gases and providing fast response to fuel demand. This adaptability to varying demand reduces the need for a multiplicity of systems to meet varying demand systems, i.e., according to the present invention, a system can provide from 100,000 Btu/hour to 10,000,000 Btu/-hour instead of one with a range of only 600,000 Btu/-hour to 2,000,000 Btu/hour.

DETAILED DESCRIPTION OF THE PREFERRED EMBODIMENT

Figure 1:
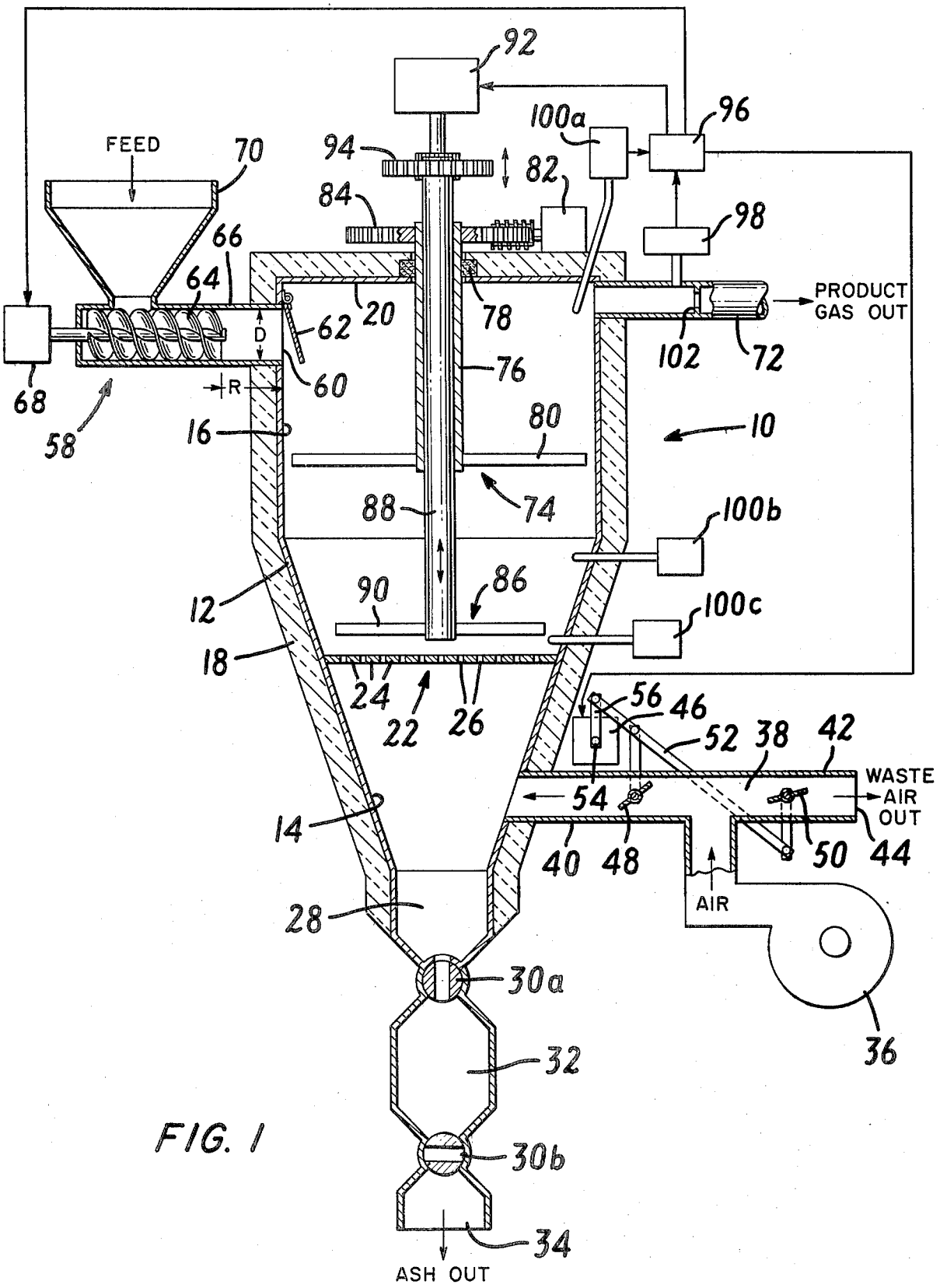
FIG. 1 shows a cross-section of the first embodiment of the invention.

Referring now to FIG. 1, there is shown in cross section a first embodiment of the pyrolysis equipment 10 according to the present invention. A reaction vessel 12 has a conical shaped lower part 14 and a cylindrical shaped upper part 16. The reaction vessel 12 may be of any suitable material such as steel, refractory material or combinations of the two. For example, the reaction vessel 12 may be a steel outer container lined in certain regions with fire brick. An insulating layer 18 on the exterior of the reaction vessel reduces the thermal losses from the reaction vessel to improve efficiency. The insulating layer may be of asbestos or other suitable material. A top 20 sealingly closes the upper perimeter of the reaction vessel.

The fixed grate 22 is located intermediate the conical shaped lower part 14. The reaction vessel 12 may be lined with fire brick in the region of the fixed grate 22. The grate 22 may consist of fixed bars 24 with spaces 26 between them. Ash and/or char is permitted to fall between the spaces 26 into a waste collection region 28. A substantially air-tight waste removal system periodically removes the collected waste from the waste collection region 28. The waste removal system comprises, for example, a first gate **30*a* at the bottom of the waste collection region 28 and a second gate 30*b* at the distal end of an intermediate waste holding region 32. The first gate 30*a* and second gate 30*b*** may be of any type of gate known in the art such as ball valves, sliding gate valves or any other type.

To remove ash or char from the waste collection region, first gate **30*a* is opened while second gate 30*b* remains closed. The material in waste collection region 28 drops into intermediate waste holding region 32. Due to the fact that second gate 30*b* remains closed, the air pressure and material in the intermediate waste holding region are not permitted to escape. First gate 30*a* is then closed and second gate 30*b* is opened. This permits the material to be discharged from the system through a waste discharge 34. Since first gate 30*a*** is closed at this time, this discharge is accomplished without losing air pressure from the reaction vessel.

A blower 36 provides a flow of air to a Tee 38. A first branch 40 conduit of the Tee 38 is connected to the conical cylindrical lower part 14 below the grate 22. A second branch 42 of the Tee 38 is vented to atmosphere through an exhaust port 44.

The amount of air flowing through first branch 40 into the reaction vessel 12 is controlled by a motor 46 which controls dampers 48 and 50 by means of a linkage 52. When the shaft 54 of the motor 46 is turned, the resulting motion of an arm 56 connected to the shaft 54 displaces the linkage 52 such that dampers 48 and 50 produce opposite effects in their arms of the Tee 38. For example, in the condition shown, when arm 56 rotates in the clockwise direction, damper 48 tends to open and damper 50 tends to close. Consequently, increased air flow and pressure flows along branch 40 into the reaction vessel and thus flows through exhaust port 44 to atmosphere. When arm 56 rotates counterclockwise, damper 48 becomes more fully closed, and damper 50 becomes more fully open. It is therefore possible by control of motor 46 to vary the air flow from the blower 36 into the reaction vessel 12 using a constant speed blower 36. It would be evident to one skilled in the art that either one or both of dampers 48 and 50 could be eliminated without departing from the spirit of the invention. For example, if damper 48 were eliminated, actuation of damper 50 in the manner described would change the balance of air flow between reaction vessel 12 and exhaust port 44. If damper 50 were replaced by a closed barrier in branch 42, varying the position of damper 48 would control the flow of the air into the reaction vessel 12. As the damper 48 assumed a more and more closed position, the blower 36 would operate less efficiently. In addition, a variable speed and/or variable capacity blower 36 may be employed without employing either damper 48 or 50. In that case, the blower output would be fed directly into the reaction vessel.

A feed mechanism 58 feeds raw material into the cylindrical upper parts 16 through a feed port 60. A hinged door 62 which may be spring loaded in the closed position but which is preferably urged to close only by gravity covers the feed port 60. An auger 64 in an auger cylinder 66 is rotated by a feed motor 68. A feed hopper 70 is optionally provided to conduct the raw material into the auger cylinder 66.

The spiral auger 64 is terminated a distance R from the feed port 60. With the assistance of the hinged door 62, forward transport of the feed material by the auger causes the feed material to build up into a plug in the space R and to thus prevent loss of gases and product chemicals through the feed system from the reaction vessel. As previously mentioned, the distance R should at least exceed the diameter D of the auger cylinder 66 in order to obtain good sealing. Product gases and their contained chemicals exit the reaction vessel 12 through a gas outflow line 72 to conventional separation and storage and additional processing well known in the art.

An upper agitator 74 has a hollow shaft 76 extending axially through the top 20 and is sealed against gas flow by a seal 78. A plurality of blades 80 are radially attached to the hollow shaft. Although any number of blades may be used, the preferred number of blades in the agitator is 6. The blades 80 should extend close to the walls to prevent the accumulation of material and to maintain flow. An upper agitator drive motor 82 drives a gear 84 attached to the hollow shaft 76 causing the hollow shaft 76 and its attached blades 80 to rotate about the axis. The upper agitator 74 may be translated upward and downward as necessary to accommodate different feed materials and operating conditions but is preferably fixed by the design of the pyrolysis equipment. Similarly, the rotation rate of the blades 80 may be made variable but is preferably fixed at between 5 and 50 revolutions per minute (rpm) and most preferably between about 8 and about 12 rpm. The stirring produced by the rotating blades 80 need only be sufficient to keep particles of the downcoming raw material from becoming stuck into a solid mass by pyroliginous vapors passing through them originating from the pyrolytic reaction below. Excessive agitation causes loss due to heat transfer between new material and material already present in the system.

A lower agitator 86 has a solid shaft 88 coaxial with the hollow shaft 76 and extending downward closer to the grate 22 than the upper agitator 74. A plurality of blades 90 are radially affixed at the bottom of the solid shaft 88. Although any number of blades 90 may be used, in the preferred embodiment, 3 blades 90 are equally spaced about the solid shaft 88.

The solid shaft 88 extends upward beyond the top of the upper agitator 74. An upper agitator drive motor 92 is connected to rotate the solid shaft 88 and its attached blades 90 using, for example, a gear 94.

A controller 96 receives inputs from sensors such as pressure sensor 98 and temperature and/or chemical sensors 100*a*, 100*b*, 100*c*.

When a pressure sensor 98 such as, for example, a pressure control type C437F1003 manufactured by Honeywell, is used, the flow rate of the outflowing product gas can be converted into pressure using a restrictive orifice such as at 102 in the outflow line 72 to produce a pressure which is related to flow rate. Alternatively, other kinds of flow and/or pressure sensing techniques may be employed.

The controller 96 may be a simple electric solenoid device which provides drive output signals to the motor 46, the upper agitator drive motor 92 and the auger feed motor 68. Alternatively, the controller 96 may be more complex up to and including a digital, analog or hybrid data processor for generating the required control signals.

Figure 2:
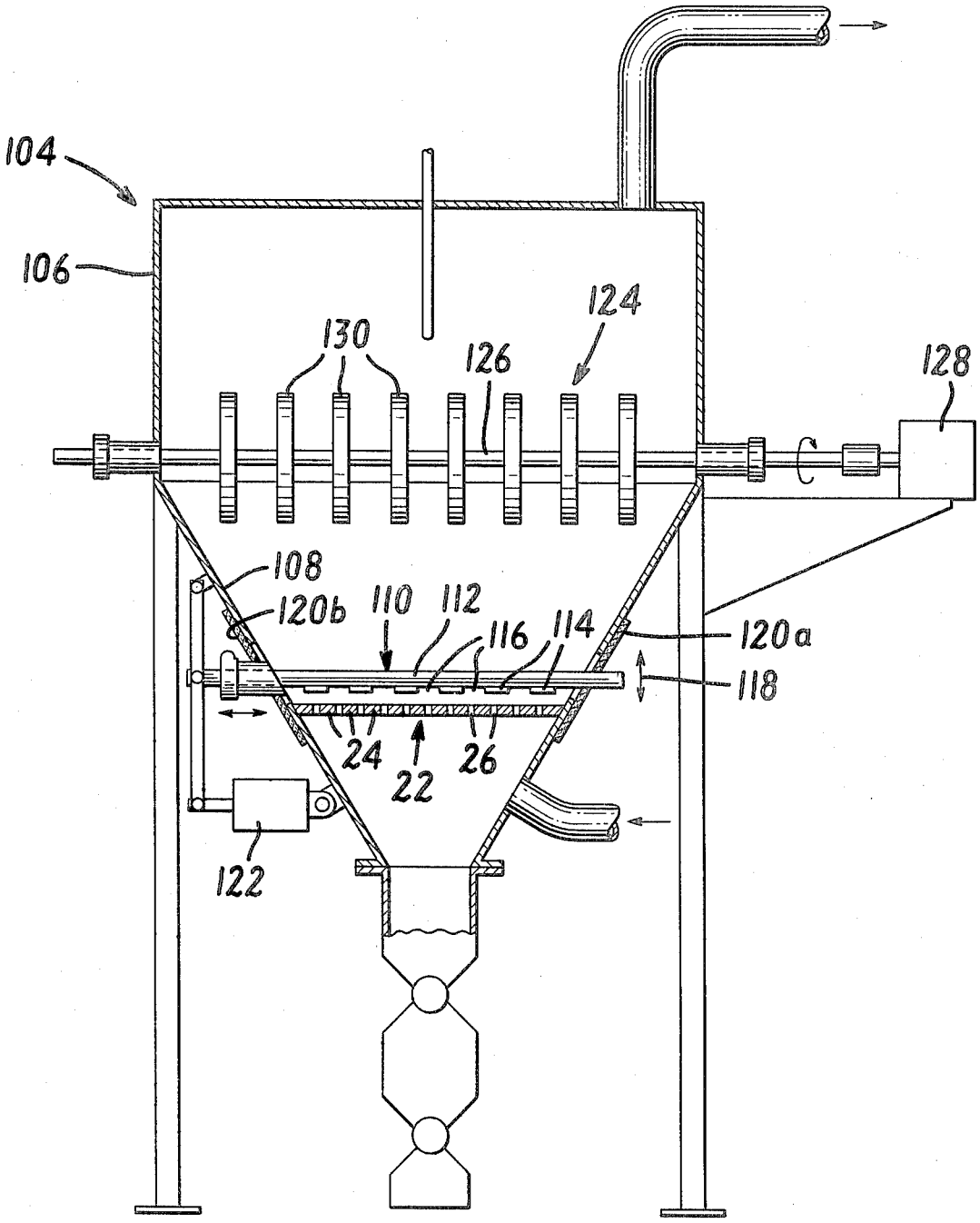
FIG. 2 shows a cross-section of the second embodiment of the invention.

Referring now to FIG. 2, there is shown a second embodiment of the pyrolysis equipment 104. This embodiment is especially suited for a device having an upper part 106 of a rectangular cross section and a lower part 108 forming a flat sided conical structure. An oscillatory lower agitator 110 made up a main transverse bar 112 to which are affixed plurality of parallel rods 114 having spaces 116 therebetween. The oscillatory lower agitator is arranged to be translated vertically as shown by the arrow at 118 closer to or further away from the grate 22. A sliding seal 120*a*, 120*b* on either side of the lower part 108 prevents the escape of gases through the necessary slot in the lower part 108. An electrical or pneumatic actuator 122 is coupled to the end of the main transverse bar to produce oscillation. As in the preceding described embodiment, the oscillation rate is controllable to control the rate of burning.

An upper agitator 124 is arranged on a horizontal shaft 126 which is rotated by an upper agitator motor 128. A series of round plates 130 is spaced along the horizontal shaft 126. It has been found that rotating the round plates in the feed material in the upper part 106 is satisfactory to provide the agitating action for smooth feeding to the reaction zones below. In certain applications, certain variations of the upper agitator may be employed. For example, one or more of the plates 130 may be replaced with bars to give more vigorous agitation. In addition, one or more of the plates may be skewed on the horizontal shaft 126 to give a component of lateral motion to the material being agitated. The spacing between the plates 130 is preferably between about 2 and about 6 inches and is preferably between about 3 and about 5 inches.

The included angle within the conical lower part 108 is preferably from about 45° to about 90° and is most preferably from about 55° to about 65° with best operation being achieved at about 58°.

It will be understood that the claims are intended to cover all changes and modifications of the preferred embodiments of the invention, herein chosen for the purposes of illustration which do not constitute departures from the spirit and scope of the invention.

What is claimed is:

1. A pyrolysis apparatus comprising:

(a) a sealed reaction vessel;

(b) a lower portion of said vessel having a tapering shape, said tapering shape having its apex downwardly located;

(c) a grate located intermediate the upper and lower ends of said tapering shape extending substantially across the entire cross-section thereof dividing said lower portion of said vessel into an upper sector and a lower sector;

(d) a movable lower agitator above said grate;

(e) said lower agitator being displaceable toward and away from said grate;

(f) an upper agitator above said lower agitator operable independently of the lower agitator;

(g) feed means for feeding raw material to be pyrolyzed to said reaction vessel above said grate;

(h) means for varying the agitation of said lower agitator to control the feed rate of said material to be pyrolyzed to said grate;

(i) air pressure supply means for supplying air under pressure to said reaction vessel below said grate to sustain a combustion zone within said upper sector just above said grate;

(j) means for varying said air pressure;

(k) means for removing uncombusted residue below said grate; and (l) means for removing gaseous products from the top of said reaction vessel.

2. The pyrolysis apparatus recited in claim 1 wherein said feed means includes means for providing a variable feed rate.

3. The pyrolysis apparatus recited in claim 1 further comprising sensor and control means for sensing at least one condition in said reaction vessel and for controlling at least said means for varying said air pressure.

4. The pyrolysis apparatus recited in claim 3 further comprising said sensor and control means being further operative to control said lower agitator agitation.

5. The pyrolysis apparatus recited in claim 4 wherein said sensor and control means are further operative to control said feed means.

6. The pyrolysis apparatus recited in claim 1 further comprising:

(a) said air pressure feed means comprising:

(i) a blower;

(ii) a conduit between said blower and said reaction vessel; and (b) said means for varying said air pressure comprising:
(i) at least one damper in said conduit;
(ii) means for varying the angle of said damper in said conduit.

7. The pyrolysis apparatus recited in claim 1 wherein said uniform cross section region has a circular cross-section and said tapering shape is conical.

8. The pyrolysis apparatus recited in claim 1 wherein said uniform cross section region has a rectangular cross section and said tapering shape is generally pyramidal.

9. The pyrolysis apparatus recited in claim 1 wherein said means for removing uncombusted residue comprises:
(a) a first substantially air tight gate in the bottom of said tapering shape;
(b) an ash holding region below said first gate;
(c) a second substantially air tight gate in the bottom of said ash holding region; and
(d) an ash discharge below said second gate.

10. The pyrolysis apparatus recited in claim 1 wherein said feed means comprises:
(a) an auger cylinder communicating with an upper portion of said reaction vessel;
(b) a spiral auger rotatable in said auger cylinder;
(c) means for feeding raw material to said auger;
(d) means for rotating said auger whereby said raw material is urged toward said reaction vessel; and
(e) said auger ending in said auger cylinder short of said reaction vessel a distance at least equal to the diameter of said auger.

11. The pyrolysis apparatus recited in claim 1 further comprising said tapering shape having an included angle of from about 45 to about 90 degrees.

12. The pyrolysis apparatus recited in claim 11 wherein said included angle is from about 55 to about 65 degrees.

13. The pyrolysis apparatus recited in claim 1 wherein said upper and lower agitators comprise:
(a) a hollow shaft axially penetrating the top of said reaction vessel;
(b) at least one agitator arm radially extending outward from the lower end of said hollow shaft;
(c) first rotating means for rotating said hollow shaft at a first rate;
(d) a solid shaft coaxially disposed in said hollow shaft extending below and above the ends of said hollow shaft;
(e) at least a second arm radially extending outward from the lower end of said solid shaft;
(f) second rotating means for rotating said solid shaft at a second variable rate; and
(g) means for axially translating said solid shaft and at least a second arm.

14. In a pyrolysis apparatus of the type having a sealed reaction vessel, and means for removing gaseous product and other residues from the reaction vessel,
(a) a grate located intermediate the upper and lower ends of said reaction vessel, extending substantially across the entire cross-section thereof; defining thereby an upper section and lower section of said sealed reaction vessel;
(b) a movable lower agitator above said grate;
(c) said movable lower agitator including:
(i) a horizontally oscillatory bar having transverse bars attached thereto;
(ii) means for translating said bar toward and away from said grate;
(iii) means for horizontally oscillating said bar at a variable rate;
(d) an upper agitator above said lower agitator operable independently of the lower agitator;
(e) said upper agitator including:
(i) a second bar extending horizontally across said upper section of said sealed reaction vessel;
(ii) a plurality of plates disposed on said second bar;
(iii) means for rotating said second bar at a rate independent of movement of said first bar;
(f) feed means for feeding raw materials to said sealed reaction vessel;
(g) air pressure means for supplying air under pressure to said sealed reaction vessel; and
(h) means for varying said air pressure.

15. The pyrolysis apparatus recited in claim 14 further comprising sensor and control means for sensing at least one condition in said reaction vessel and for controlling at least said means for varying said air pressure.

16. The pyrolysis apparatus recited in claim 15 further comprising said sensor and control means being further operative to control the agitation of said lower agitator.

17. The pyrolysis apparatus recited in claim 16 wherein said feed means includes means for varying the feed rate and said sensor and control means are further operative to control said means for varying the feed rate.

18. In pyrolysis apparatus of the type having a sealed reaction vessel, means for removing gaseous products from the sealed reaction vessel, means for feeding raw materials into said reaction vessel, air pressure supply means, means for removing uncombusted residue, and a grate supporting a combustion zone inside said sealed reaction vessel,
(a) a movable lower agitator above said grate;
(b) said lower agitator including:
(i) a horizontally oscillatory bar having transverse bars attached thereto;
(ii) means for translating said bar toward and away from said grate;
(iii) means for horizontally oscillating said bar at a variable rate;
(c) an upper agitator above said lower agitator and operable independently of the lower agitator;
(d) said upper agitator including:
(i) a second bar extending horizontally across said upper portion of said sealed reaction vessel;
(ii) a plurality of plates disposed on said second bar;
(iii) means for rotating said second bar at a rate independent of the movement of said first bar.

19. A pyrolysis apparatus comprising:
(a) a sealed reaction vessel having a pyramidal lower portion joined to a parallelipiped upper portion;
(b) a grate intermediate the top and bottom of said pyramidal lower portion and extending substantially across the cross-section thereof;
(c) an air blower;
(d) a conduit between said air blower and said reaction vessel below said grate;
(e) control means for controlling the amount of air flowing through said conduit;
(f) feed means for feeding material to be treated to said parallelipiped upper portion;
(g) an out-flow line in said parallelipiped portion for carrying of gaseous products of the reaction;
(h) an upper agitator;
(i) said upper agitator comprising:

(i) a bar extending horizontally across said parallelipiped upper portion;

(ii) a plurality of plates disposed on said bar;

(j) means for driving said upper agitator to rotate at a variable rate;

(k) a lower agitator below said upper agitator and above said grate;

(l) said lower agitator comprising;

(i) a horizontally oscillatory bar having transverse bars attached thereto above said grate;

(ii) at least a first end of said bar extending into and through said pyramidal lower portion;

(iii) at least one seal for sealing about the portion of said bar which extends through said pyramidal lower portion;

(iv) means for permitting translation of said bar toward and away from said grate.

20. In a pyrolysis apparatus of the type having a sealed reaction vessel, means for feeding raw materials to said sealed reaction vessel and means for removing gaseous product and residues from the reaction vessel, (a) a lower portion of said vessel having a tapering shape, the cross-sectional area at the bottom of said lower portion being less than the cross-sectional area at the top of said lower portion;

(b) A grate located intermediate the top and bottom of said lower portion, said grate extending substantially across the entire cross-section thereof (c) movable lower agitator above said grate;

(d) means for moving said lower agitator;

(e) means for translating said lower agitator toward and away from said grate;

(f) an upper agitator above said lower agitator;

(g) means for moving said upper agitator independently of the movement of said lower agitator.

21. The pyrolysis apparatus of claim 20 wherein the lower agitator is located in the lower tapered portion of the reaction vessel and the upper agitator is located in the upper portion of the reaction vessel.

22. The pyrolysis apparatus of claim 20 wherein the lower agitator is horizontally oscillatable.

* * * * *